US010508866B2

(12) United States Patent
Leman et al.

(10) Patent No.: US 10,508,866 B2
(45) Date of Patent: Dec. 17, 2019

(54) REFRIGERANT TO WATER HEAT EXCHANGER

(71) Applicant: Carrier Corporation, Farmington, CT (US)

(72) Inventors: Derek Leman, Brownsburg, IN (US); Mark Shoemaker, Brownsburg, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 1358 days.

(21) Appl. No.: 14/216,471

(22) Filed: Mar. 17, 2014

(65) Prior Publication Data

US 2014/0318752 A1 Oct. 30, 2014

Related U.S. Application Data

(60) Provisional application No. 61/817,347, filed on Apr. 30, 2013.

(51) Int. Cl.

| | |
|---|---|
| ***F28D 7/02*** | (2006.01) |
| ***B21C 37/15*** | (2006.01) |
| ***B21D 39/04*** | (2006.01) |
| ***B21D 53/06*** | (2006.01) |

(52) U.S. Cl.

CPC ..... *F28D 7/022* (2013.01); *B21C 37/154* (2013.01); *B21D 39/04* (2013.01); *B21D 53/06* (2013.01); *Y10T 29/4935* (2015.01)

(58) Field of Classification Search

CPC ..... F28D 7/022; B21C 37/154; B21D 39/04; B21D 53/06; Y10T 29/4935

USPC ..... 165/164, 141

See application file for complete search history.

(56) References Cited

U.S. PATENT DOCUMENTS

| | | | | | |
|---|---|---|---|---|---|
| 2,913,009 | A | * | 11/1959 | Kuthe | F28D 7/10 138/148 |
| 4,363,221 | A | | 12/1982 | Singh | |
| 4,411,307 | A | | 10/1983 | Ecker | |
| 4,419,802 | A | * | 12/1983 | Riese | B21C 37/151 165/179 |
| 4,428,106 | A | | 1/1984 | Campbell et al. | |
| 4,444,022 | A | | 4/1984 | Holt et al. | |
| 4,690,208 | A | | 9/1987 | Deck | |
| 4,694,864 | A | | 9/1987 | Libin | |
| 4,744,412 | A | | 5/1988 | Kim et al. | |
| 5,375,654 | A | * | 12/1994 | Hougland | F28F 13/12 138/38 |
| 6,098,704 | A | * | 8/2000 | Tsuchiya | B21C 23/10 165/154 |

(Continued)

FOREIGN PATENT DOCUMENTS

| | | |
|---|---|---|
| JP | 2004340555 | 12/2004 |
| JP | 2005030619 | 2/2005 |

(Continued)

*Primary Examiner* — Raheena R Malik

(74) *Attorney, Agent, or Firm* — Cantor Colburn LLP

(57) ABSTRACT

A heat exchanger having at least one inner conduit comprising of a second tubular member coaxially disposed within a first tubular member, wherein the second tubular member outer surface is in contact with the first tubular member inner surface. Each of the first and second tubular members is composed of a material with an approximately 0.015 inch maximum wall thickness.

17 Claims, 4 Drawing Sheets

(56) References Cited

U.S. PATENT DOCUMENTS

| | | | | |
|---|---|---|---|---|
| 6,220,344 | B1 * | 4/2001 | Beykirch | F28D 7/022 165/154 |
| 6,751,983 | B1 | 6/2004 | Dienhart et al. | |
| 6,920,917 | B2 * | 7/2005 | Inoue | F28F 1/06 165/154 |
| 2007/0012426 | A1 * | 1/2007 | Rago | F28F 13/125 165/92 |
| 2010/0326640 | A1 | 12/2010 | Higashiyama et al. | |
| 2011/0023519 | A1 * | 2/2011 | Dong | F25B 39/02 62/340 |
| 2011/0214847 | A1 * | 9/2011 | Hur | F28D 7/106 165/143 |
| 2012/0199326 | A1 * | 8/2012 | Sheldon | F25B 40/00 165/154 |
| 2013/0146262 | A1 * | 6/2013 | Huh | F28D 7/10 165/154 |
| 2015/0168074 | A1 * | 6/2015 | Bariar | F28D 7/106 165/154 |

FOREIGN PATENT DOCUMENTS

| | | |
|---|---|---|
| JP | 2008057860 | 3/2008 |
| JP | 2009162395 | 7/2009 |
| JP | 2009162396 | 7/2009 |

* cited by examiner

REFRIGERANT TO WATER HEAT EXCHANGER

CROSS REFERENCE TO RELATED APPLICATIONS

The present application is related to, and claims the priority benefit of, U.S. Provisional Patent Application Ser. No. 61/817,347 filed Apr. 30, 2013, the contents of which are hereby incorporated in their entirety into the present disclosure.

TECHNICAL FIELD OF THE DISCLOSED EMBODIMENTS

The presently disclosed embodiments generally relate to heat transfer devices, and more particularly, to a refrigerant-to-water heat exchanger.

BACKGROUND OF THE DISCLOSED EMBODIMENTS

A heat exchanger is a device used to passively transfer heat from one material to another. These materials may be liquid or gaseous, depending on the situation in which the heat exchanger is being utilized. Heat exchangers are basically two chambers separated by a heat transmitting barrier Typical refrigerant-to-water heat exchangers, are available as coaxial heat exchangers or brazed plate heat exchangers. Coaxial heat exchangers consist of a double-walled corrugated copper tube inserted through a larger steel tube. Heat exchange takes place as water flows through the center of the corrugated copper tube and a refrigerant flows between the corrugated copper and steel tubes. A double-walled coaxial heat exchanger, using corrugated copper, typically requires a 0.060-0.080 inch wall thickness of the corrugated copper tube. There is therefore a need for a double-walled heat exchanger with thinner walls.

SUMMARY OF THE DISCLOSED EMBODIMENTS

In one aspect, a refrigerant-to-water heat exchanger is provided. The heat exchanger includes an outer conduit, and at least one inner conduit disposed within the outer conduit.

In one embodiment, an inner conduit includes a first tubular member, and a second tubular member coaxially disposed within the first tubular member. In one example, the first tubular member is formed from a copper refrigeration tube having a 5/16 inch outer diameter with an approximately 0.015 inch maximum wall thickness. In another example, the first tubular member has a wall thickness of approximately 0.010-0.015 inch. In another example, the first tubular member has a wall thickness less than approximately 0.010 inch. In one example, the second tubular member is formed from a copper refrigeration tube having an approximately 0.015 inch maximum wall thickness. In another example, the second tubular member has a wall thickness of approximately 0.010-0.015 inch. In another example, the second tubular member has a wall thickness less than approximately 0.010 inch. In another embodiment, the first tubular member and the second tubular member may be formed from aluminum refrigeration tubing. In one example, the inner surfaces of the first tubular member and the second tubular member include enhancements disposed therein. The enhancements include depressions formed by extruding continuous pieces of material longitudinally throughout the inner surfaces of the first tubular member and the second tubular member to increase the surface area thereof.

In one example, the second tubular member is expanded within the first tubular member such that the protrusions of the inner surface of the first tubular member are in contact with the outer surface of the second tubular member.

In one embodiment, a first liquid, for example a refrigerant, flows through the inner conduit, and a second liquid, for example water, flows between the outer conduit and the inner conduit. As hot refrigerant flows through the inner conduit and water flows between the outer conduit and the inner conduit, heat transfers from the inner conduit into the water to be distributed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
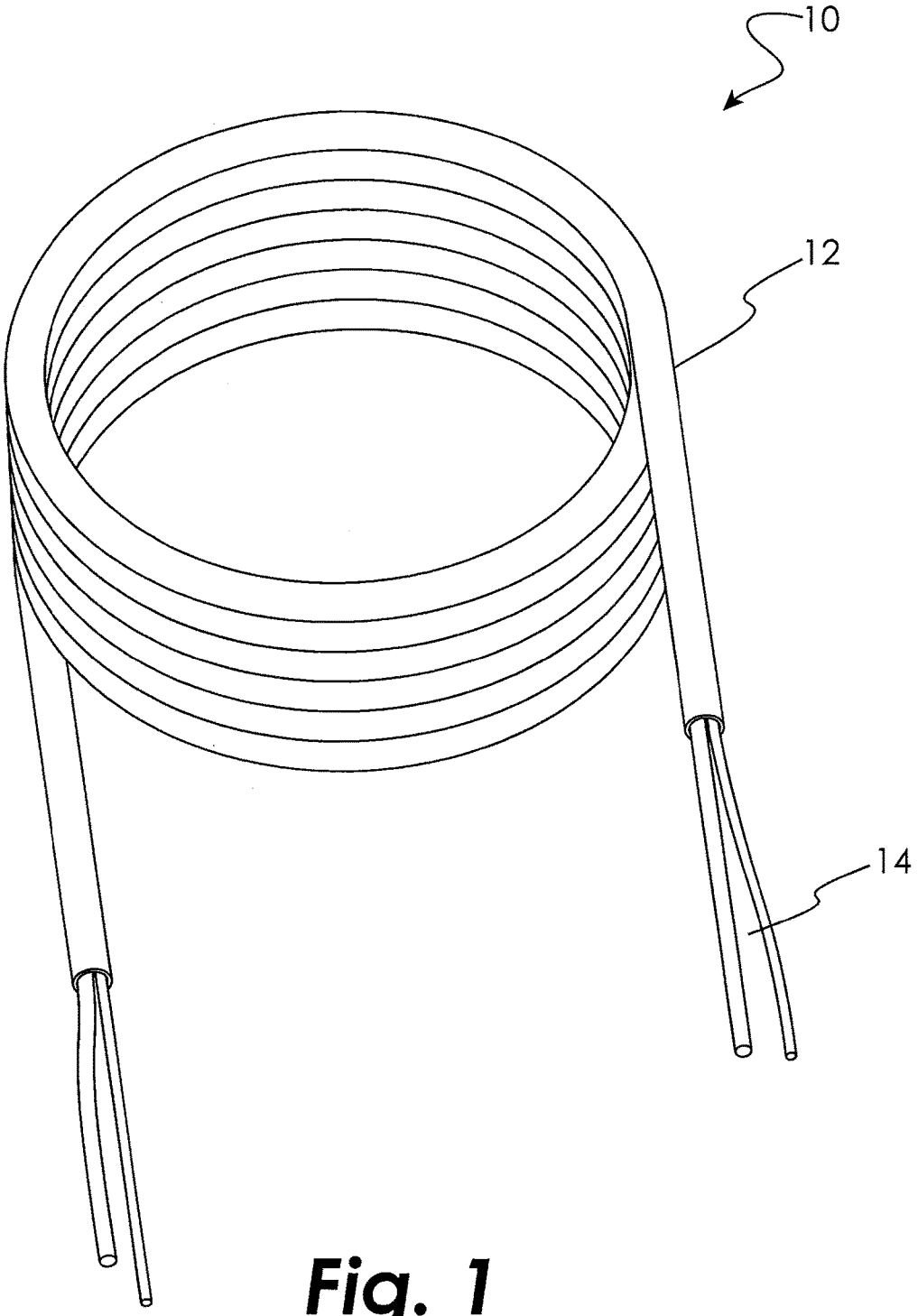
FIG. 1. shows a perspective view of a refrigerant-to-water heat exchanger in an exemplary embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
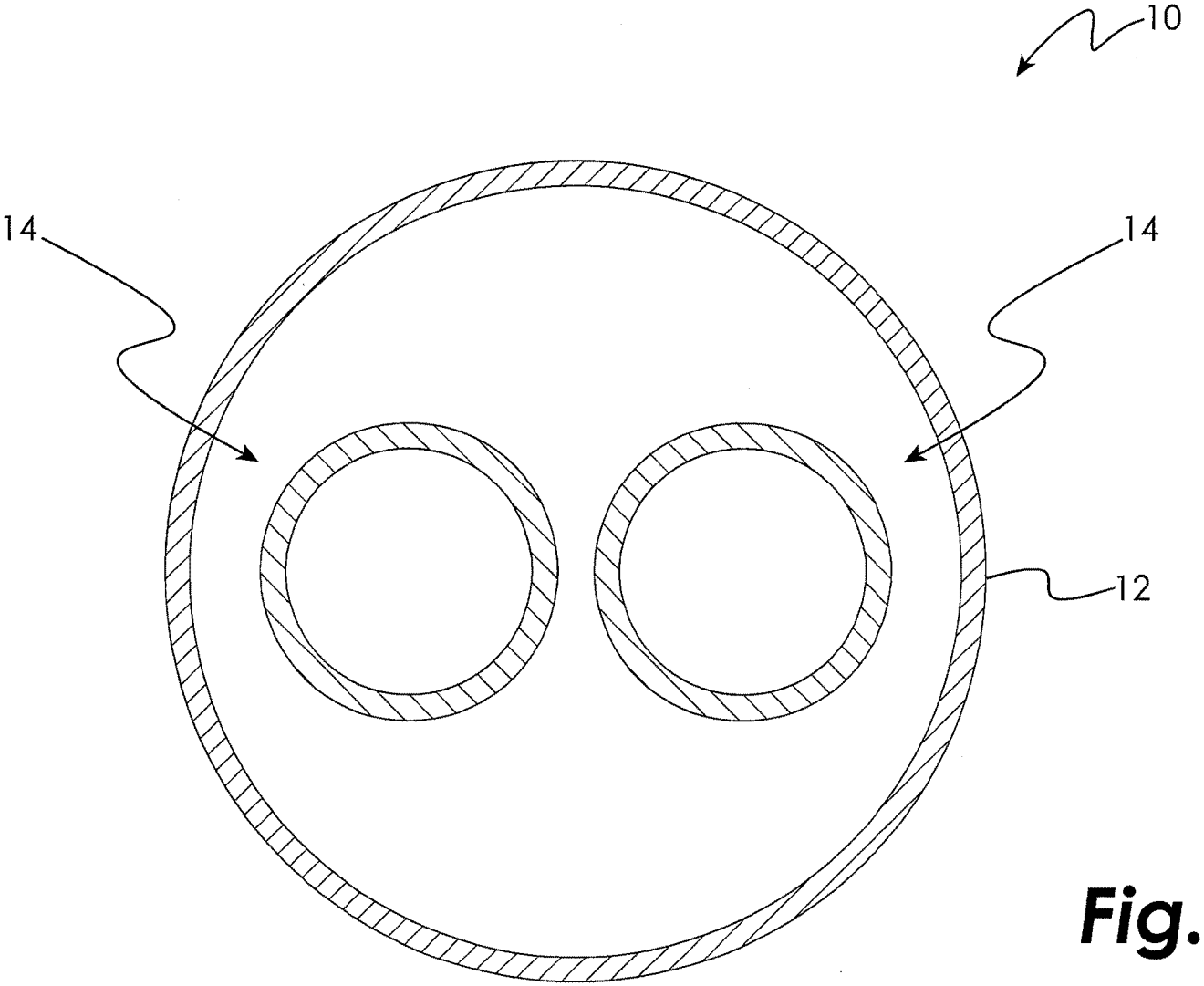
FIG. 2 shows a cross-sectional view of a refrigerant-to-water heat exchanger in an exemplary embodiment.

FIG. 1 illustrates an exemplary embodiment of a refrigerant to water heat exchanger, indicated generally at 10. Particularly, as shown in FIG. 2, the heat exchanger 10 includes an outer conduit 12 and at least one inner conduit 14 disposed within the outer conduit 12. In another embodiment, the outer conduit 12 may be removed.

Figure 3:
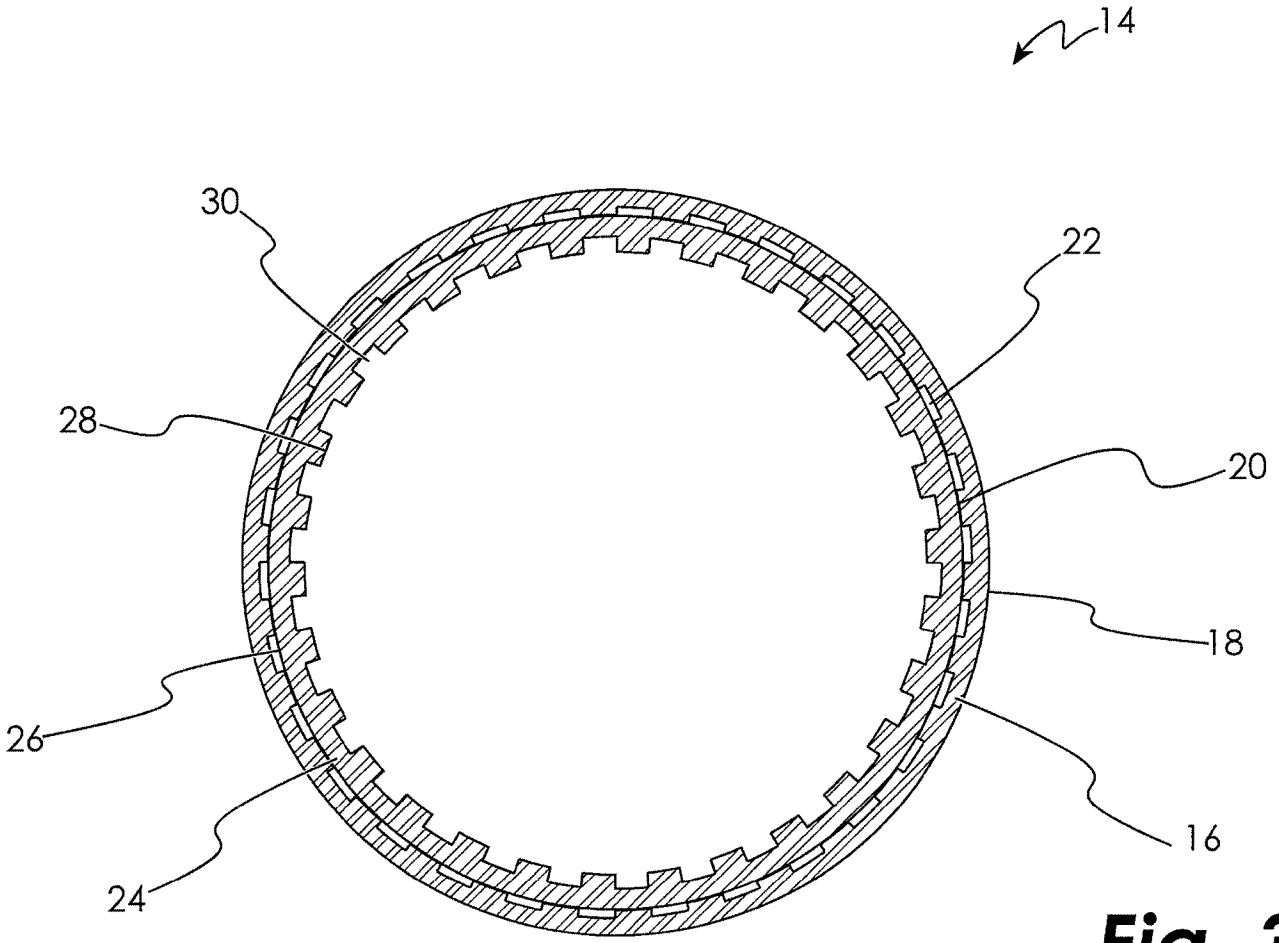
FIG. 3 shows a cross-sectional view of an inner conduit utilized in a refrigerant-to-water heat exchanger in an exemplary embodiment.

FIG. 3 illustrates an exemplary embodiment of an inner conduit 14. Inner conduit 14 includes a first tubular member 16 with an approximately 0.015 inch maximum wall thickness. In another embodiment, the first tubular member 16 has a wall thickness of approximately 0.010-0.015 inch. In another embodiment, the first tubular member 16 has a wall thickness of less than approximately 0.010 inch. The first tubular member 16 includes a first tubular member outer surface 18 and a first tubular member inner surface 20. In one embodiment, the first tubular member inner surface 20 includes enhancements 22 disposed therein. The enhancements 22 include depressions within the first tubular inner surface 20 formed by extruding continuous pieces of material longitudinally throughout the first tubular inner surface 20 to create a vent path between the first tubular inner surface 20 and a second tubular outer surface 26.

The inner conduit 14 further includes a second tubular member 24 coaxially disposed within the first tubular member 16. In an exemplary embodiment, the second tubular member 24 has an approximately 0.015 inch maximum wall thickness. In one embodiment, the second tubular member 24 has a wall thickness of approximately 0.010-0.015 inch. In another embodiment, the second tubular member 24 has a wall thickness of less than approximately 0.010 inch. The second tubular member 24 includes the second tubular member outer surface 26 and a second tubular member inner surface 28. In one embodiment, the second tubular member inner surface 28 includes enhancements 30 disposed therein. The enhancements 30 include depressions within the second tubular inner surface 28 formed by extruding continuous pieces of material longitudinally throughout the second tubular inner surface 28 to increase the surface area thereof. In an exemplary embodiment of an inner conduit 14, the second tubular member outer surface 26 is in contact with the enhancements 30 formed in the first tubular member inner surface 20. In another embodiment, the second tubular member outer surface 26 includes enhancements 30 disposed therein. The enhancements 30 include depressions within the second tubular outer surface 26 formed by extruding continuous pieces of material longitudinally throughout the second tubular outer surface 26. In one embodiment of an inner conduit 14, the enhancement 30 formed in the second tubular member outer surface 26 is in contact with the first tubular member inner surface 20

In an exemplary embodiment, the first tubular member 16 is composed of copper. In another embodiment, the first tubular member 16 is composed of aluminum. In an exemplary embodiment the second tubular member 24 is composed of copper. In another embodiment, the second tubular member 24 is composed of aluminum. The first tubular member 16 and the second tubular member 24 may be composed of any material that exhibits the desired heat transfer properties for a given application. The outer conduit 12 may be composed of any desired material such as steel or plastic to name a few non-limiting examples.

In an exemplary embodiment, the inner conduit 14 is configured to allow a first liquid to flow therethrough. In one embodiment, the first liquid is a refrigerant. In an exemplary embodiment, the outer conduit 12 is configured to allow a second liquid to flow therethrough. In one embodiment, the second liquid is water.

Figure 4:
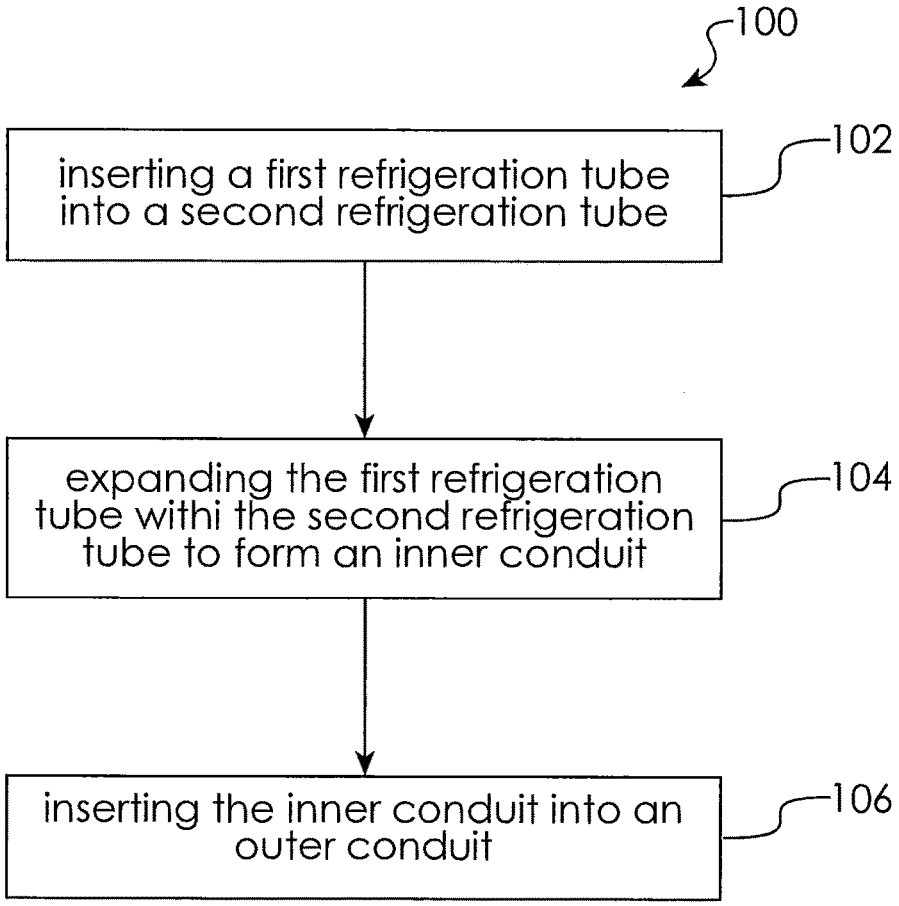
FIG. 4 shows a schematic flow chart of an exemplary method of constructing a refrigerant-to-water heat exchanger.

In an exemplary embodiment, the inner conduit 14 may be formed by using 5/16 inch refrigeration tubing as the first tubular member 16 and using 7 millimeter refrigeration tubing as the second tubular member 24. Because the 7 millimeter refrigeration tubing has an outer diameter that is less than the inner diameter of the 5/16 inch refrigeration tubing, the 7 millimeter refrigeration tubing may be inserted into the 5/16 inch refrigeration tubing in a coaxial arrangement. Thereafter, an object, for example a steel ball attached to a rod, further attached to a driving mechanism may be inserted into the interior of the 7 millimeter refrigeration tubing and run along the entire length of the 7 millimeter refrigeration tubing, thereby expanding the diameter of the 7 millimeter refrigeration tubing and bringing the outer surface of the 7 millimeter refrigeration tubing into contact with the enhancements 22 on the inner surface of 5/16 inch refrigeration tubing to form the inner conduit 14. In some embodiments, application of the object also expands the diameter of the 5/16 inch refrigeration tubing, forming an inner conduit 14 with a diameter larger than 5/16 inch. Therefore, as shown in FIG. 4, an exemplary method 100 of constructing a heat exchanger 10 includes the step 102 of inserting a first refrigeration tube, including a first inner surface, a first outer surface, and having a first diameter, into a second refrigeration tube, including a second inner surface, a second outer surface, and having a second diameter. Step 104 includes expanding the first refrigeration tube within the second refrigeration tube, wherein the first outer surface is in contact with the second inner surface, thereby forming an inner conduit. In one embodiment, the method further includes the step 106 of inserting at least one inner conduit into an outer conduit.

It will be appreciated that, because the inner conduit 14 consists of a first tubular member 16 and second tubular member 24, each having a 0.015 inches maximum wall thickness, less material than a double-walled corrugated copper heat exchanger can be used for construction thereof and provide sufficient heat transfer between a refrigerant and water.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A heat exchanger comprising:

a heat exchanger outer conduit;

at least one heat exchanger inner conduit disposed within the heat exchanger outer conduit to allow a liquid to flow between the heat exchanger outer conduit and the at least one heat exchanger inner conduit, the at least one heat exchanger inner conduit comprising:

a first tubular member including a first wall thickness, a first inner surface and a first outer surface having a first outer diameter; and a second tubular member including a second wall thickness, a second inner surface and a second outer surface having a second outer diameter, wherein the second tubular member is coaxially disposed within the first tubular member;

wherein the first inner surface includes continuous enhancements formed longitudinally therein, and the second inner surface includes continuous enhancements formed longitudinally therein, wherein the second outer surface is in contact with the enhancements on the first inner surface, wherein the first wall thickness is 0.015 inch or less, and wherein the second wall thickness is 0.015 inch or less.

2. The heat exchanger of claim 1, wherein the first wall thickness is between 0.010 inch and 0.015 inch.

3. The heat exchanger of claim 1, wherein the first wall thickness is less than 0.010 inch.

4. The heat exchanger of claim 1, wherein the second wall thickness is less than 0.010 inch.

5. The heat exchanger of claim 1, wherein the second wall thickness is between 0.010 inch and 0.015 inch.

6. The heat exchanger of claim 1, wherein the first tubular member is composed of copper refrigeration tubing.

7. The heat exchanger of claim 1, wherein the second tubular member is composed of copper refrigeration tubing.

8. The heat exchanger of claim 1, wherein the first tubular member is composed of aluminum refrigeration tubing.

9. The heat exchanger of claim 1, wherein the second tubular member is composed of aluminum refrigeration tubing.

10. The heat exchanger of claim 1, wherein the inner conduit is configured to allow a second liquid to flow therethrough.

11. The heat exchanger of claim 10, wherein the second liquid is a refrigerant.

12. The heat exchanger of claim 1, wherein the liquid is water.

13. A heat exchanger comprising:

a heat exchanger outer conduit;

at least one heat exchanger inner conduit disposed within the heat exchanger outer conduit to allow a liquid to flow between the heat exchanger outer conduit and the at least one heat exchanger inner conduit, the at least one heat exchanger inner conduit comprising:

a first tubular member including a first wall thickness, a first inner surface and a first outer surface having a first outer diameter; and a second tubular member including a second wall thickness and a second outer surface having a second outer diameter, wherein the second tubular member is coaxially disposed within the first tubular member;

wherein the second outer surface includes continuous enhancements formed longitudinally therein, wherein the first inner surface is in contact with the enhancements on the second outer surface, wherein the first wall thickness is 0.015 inch or less, and wherein second wall thickness is 0.015 inch or less.

14. The heat exchanger of claim 13, wherein the first wall thickness is between 0.010 and 0.015 inch.

15. The heat exchanger of claim 13, wherein the first wall thickness is less than 0.010 inch.

16. The heat exchanger of claim 13, wherein the second wall thickness is less than 0.010 inch.

17. The heat exchanger of claim 13, wherein the second wall thickness is between 0.010 inch and 0.015 inch.

* * * * *